US010568371B1

(12) United States Patent
Murrer et al.

(10) Patent No.: US 10,568,371 B1
(45) Date of Patent: Feb. 25, 2020

(54) ROLLED SPORTS HEADBAND

(71) Applicant: Hipsy, LLC, Cincinnati, OH (US)

(72) Inventors: Daren P. Murrer, Hamilton, OH (US); Scott Gerke, Cincinnati, OH (US)

(73) Assignee: Hipsy LLC, Cincinnati, OH (US)

( * ) Notice: Subject to any disclaimer, the term of this patent is extended or adjusted under 35 U.S.C. 154(b) by 48 days.

(21) Appl. No.: 15/869,423

(22) Filed: Jan. 12, 2018

(51) Int. Cl.
*A41D 20/00* (2006.01)

(52) U.S. Cl.
CPC ..... *A41D 20/00* (2013.01)

(58) Field of Classification Search
CPC ..... A41D 20/00
USPC ..... 2/181
See application file for complete search history.

(56) References Cited

U.S. PATENT DOCUMENTS 5,640,721 A * 6/1997 Jackson ..... A41D 20/00 2/171
2014/0259286 A1* 9/2014 Boyle ..... A41D 20/00 2/181
2015/0143615 A1* 5/2015 LePage ..... A41D 20/00 2/209.3

* cited by examiner

*Primary Examiner* — Gloria M Hale
(74) *Attorney, Agent, or Firm* — Wood Herron & Evans LLP

(57) ABSTRACT

A headband that is particularly suitable for use in sports, or fashion ensembles with a sporting appearance, which is unique in that it includes a fabric section that is formed from two oppositely-directed rolls of fabric which may be rolled or unrolled to adjust the headband width appropriately for an activity and fashion need.

9 Claims, 10 Drawing Sheets

ROLLED SPORTS HEADBAND

FIELD OF THE INVENTION

The present invention relates to headbands, and particular to headbands for use in athletic activity.

BACKGROUND OF THE INVENTION

Numerous forms of headbands and bandanas have been used for fashion purposes and to restrain sweat in sports activities. Headbands come in many shapes, sizes and varieties of color and print pattern. Demand for new fashions and functions has continued to expand the range of available products, yet there remain limitations on the functions of existing headbands.

SUMMARY OF THE INVENTION

The present invention provides a headband that is particularly suitable for use in sports, or fashion ensembles with a sporting appearance, which is unique in that it includes a fabric section that is formed from two oppositely-directed rolls of fabric which may be rolled or unrolled to adjust the headband width appropriately for an activity and fashion need.

In the disclosed particular embodiments, the headband fabric is a resilient, absorbent fabric such as spandex, Lycra® or a blend of the same with cotton and/or polyester.

In the disclosed method of making a headband of the type described, the headband fabric is rolled from its edges in oppositely directed rolls by a fixture, and then the rolled fabric is ultrasonically welded to an end piece which holds the rolled fabric in place and permits attachment of the rolled fabric to a connecting strap. The connecting strap may include an adjustable buckle, and further may be made of a resilient fabric (e.g., elastic) to help in securing the headband on the wearer's head.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
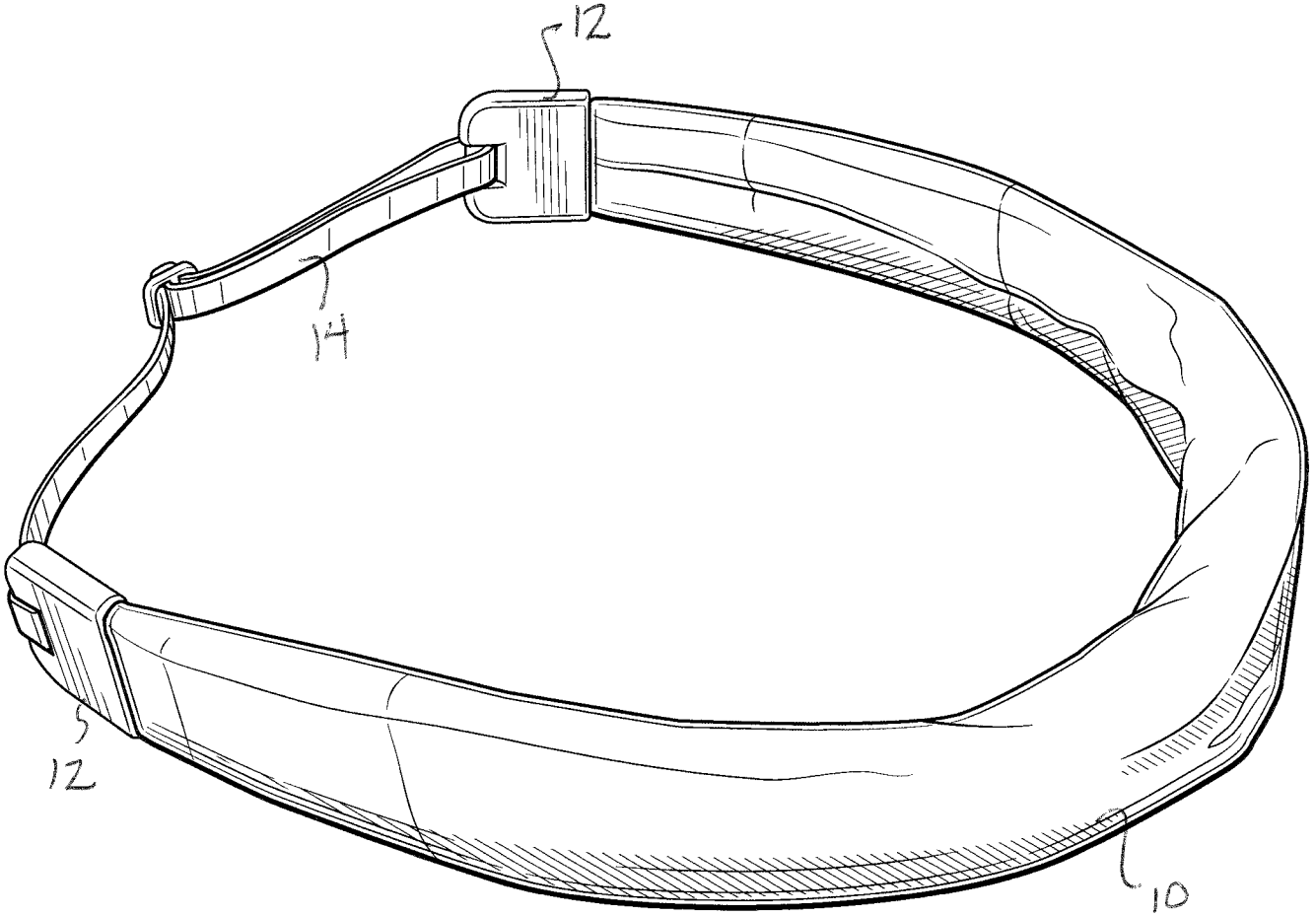
FIG. 1 illustrates a headband in accordance with principles of the present invention, which includes a rolled fabric main section, terminating in end pieces which are fastened together by an elastic strap which incorporates a length adjusting buckle.
Figure 2:
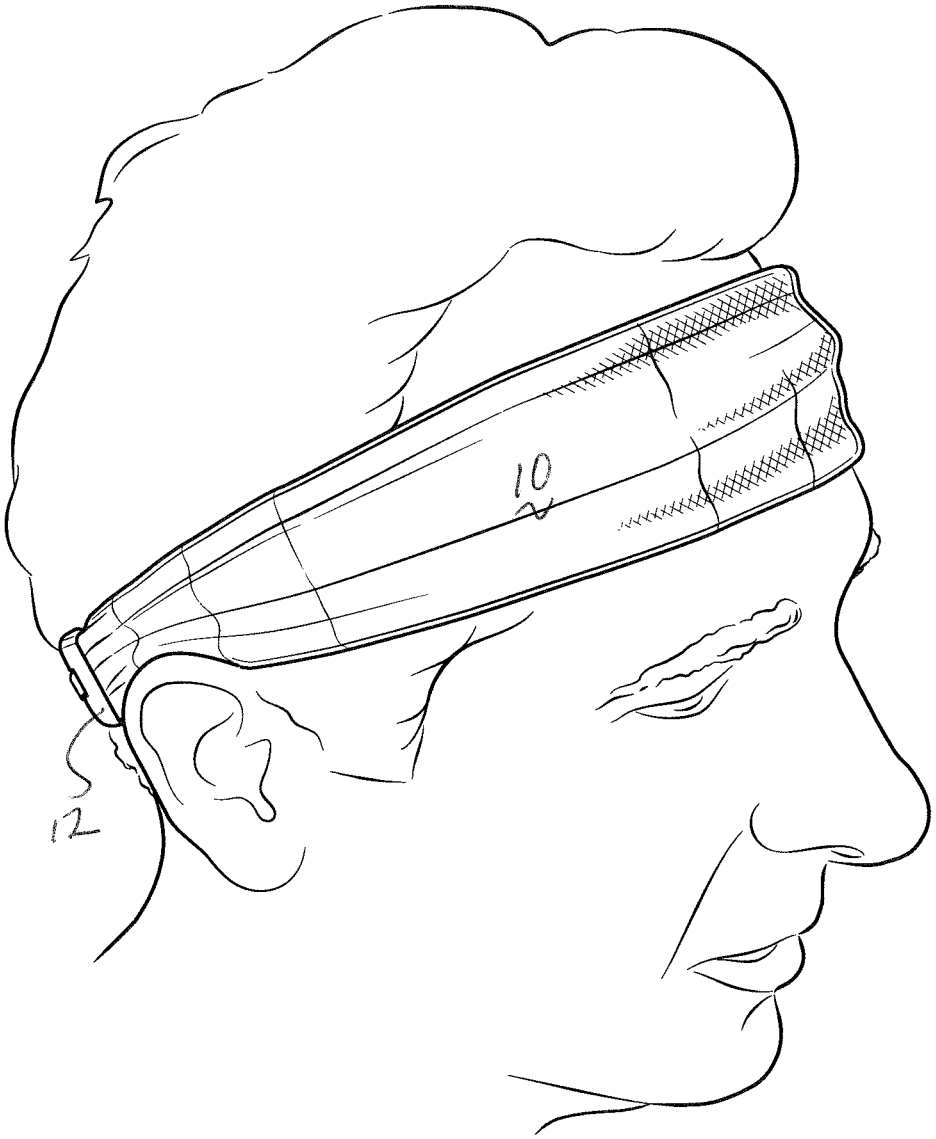
FIG. 2 illustrates the headband of FIG. 1 situated on the head of a wearer, showing the placement of the fabric main section and end piece.
Figure 3:
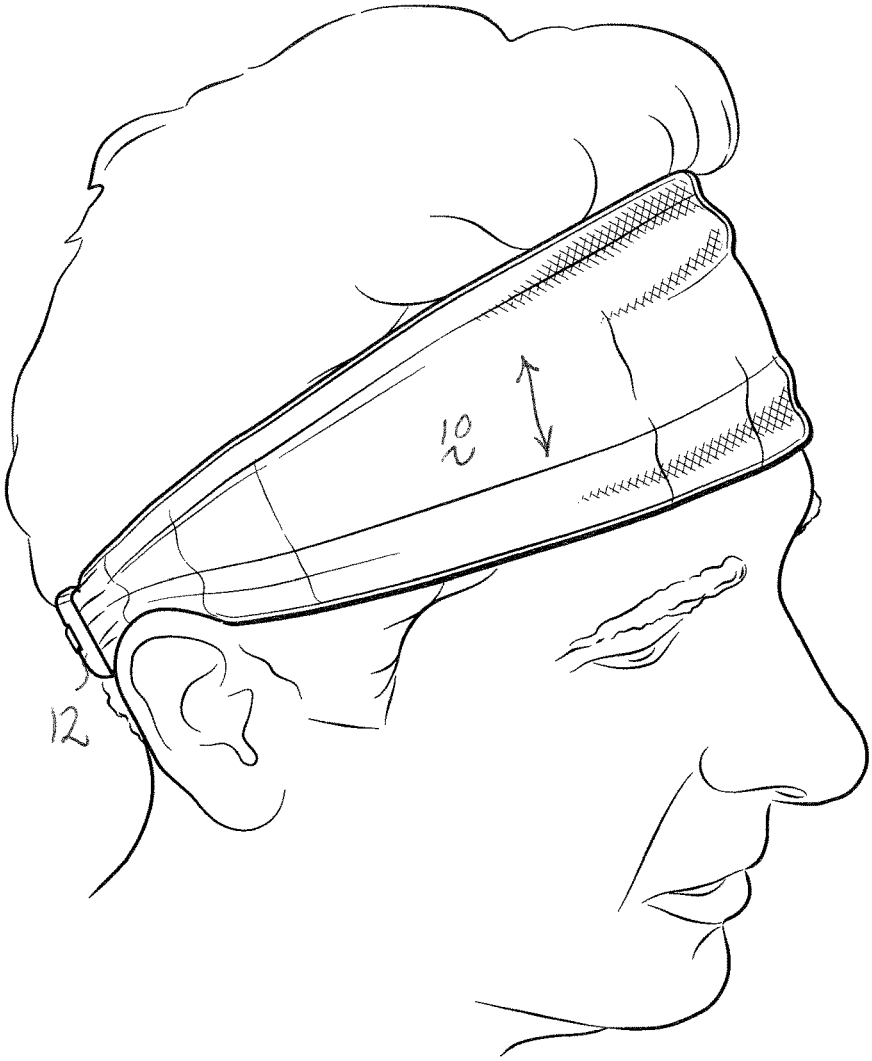
FIG. 3 illustrates the capability of adjusting the width of the headband of FIG. 1 by partially unrolling the main fabric section to create a wider headband.
Figure 4A:
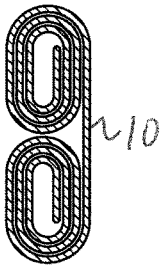
FIG. 4A is a cross section of the rolled main fabric section of the headband in the generally tightly rolled configuration shown in FIG. 2.
Figure 4B:
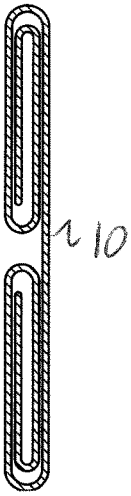
FIG. 4B is a cross section of the rolled main fabric section of the headband in the partially unrolled configuration shown in FIG. 3.
Figure 5A:
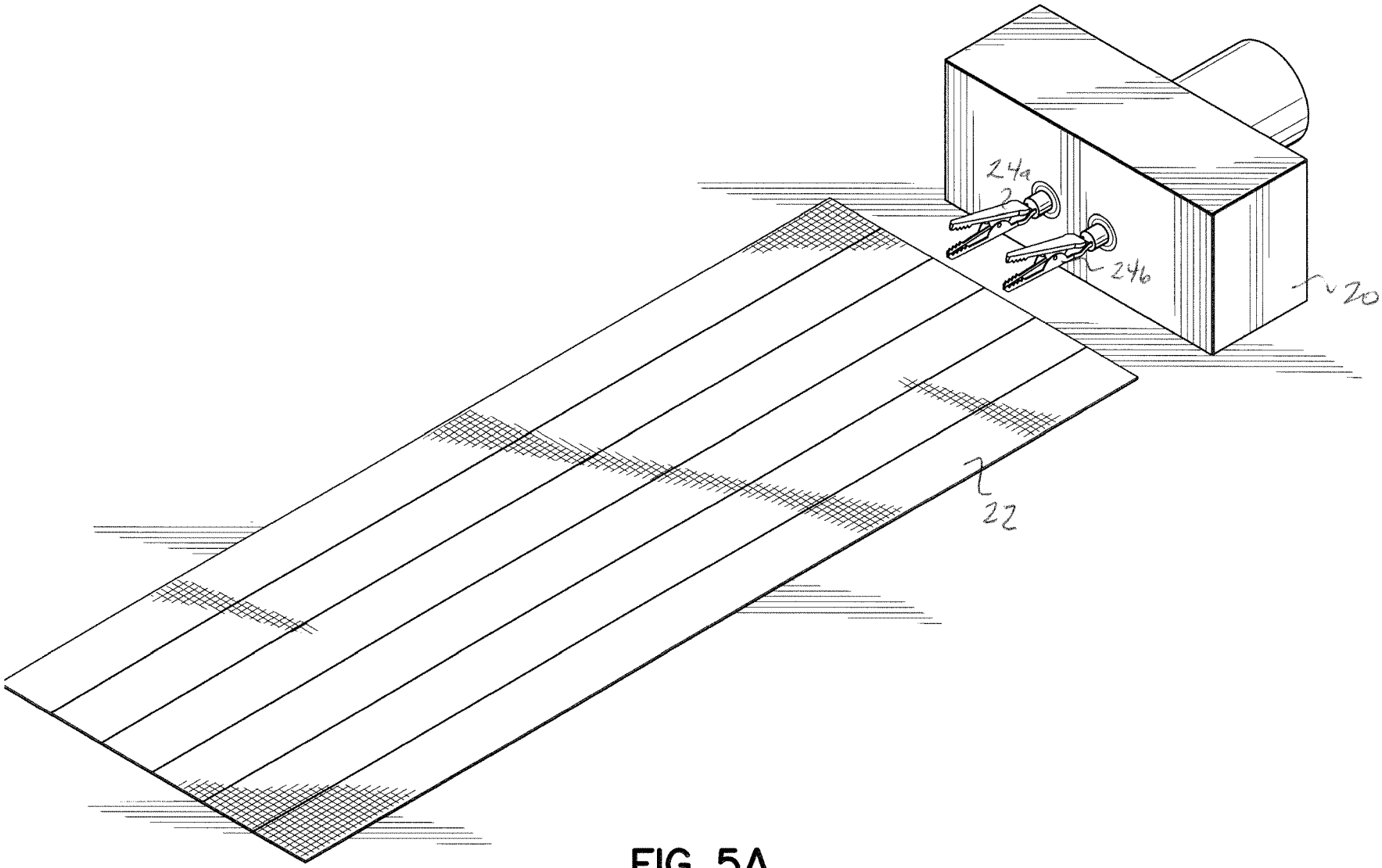
FIG. 5A is a perspective illustration of a fixture used for rolling fabric into a rolled main section of a headband, showing fabric which has been prepared for rolling but not yet processed by the fixture.
Figure 5B:
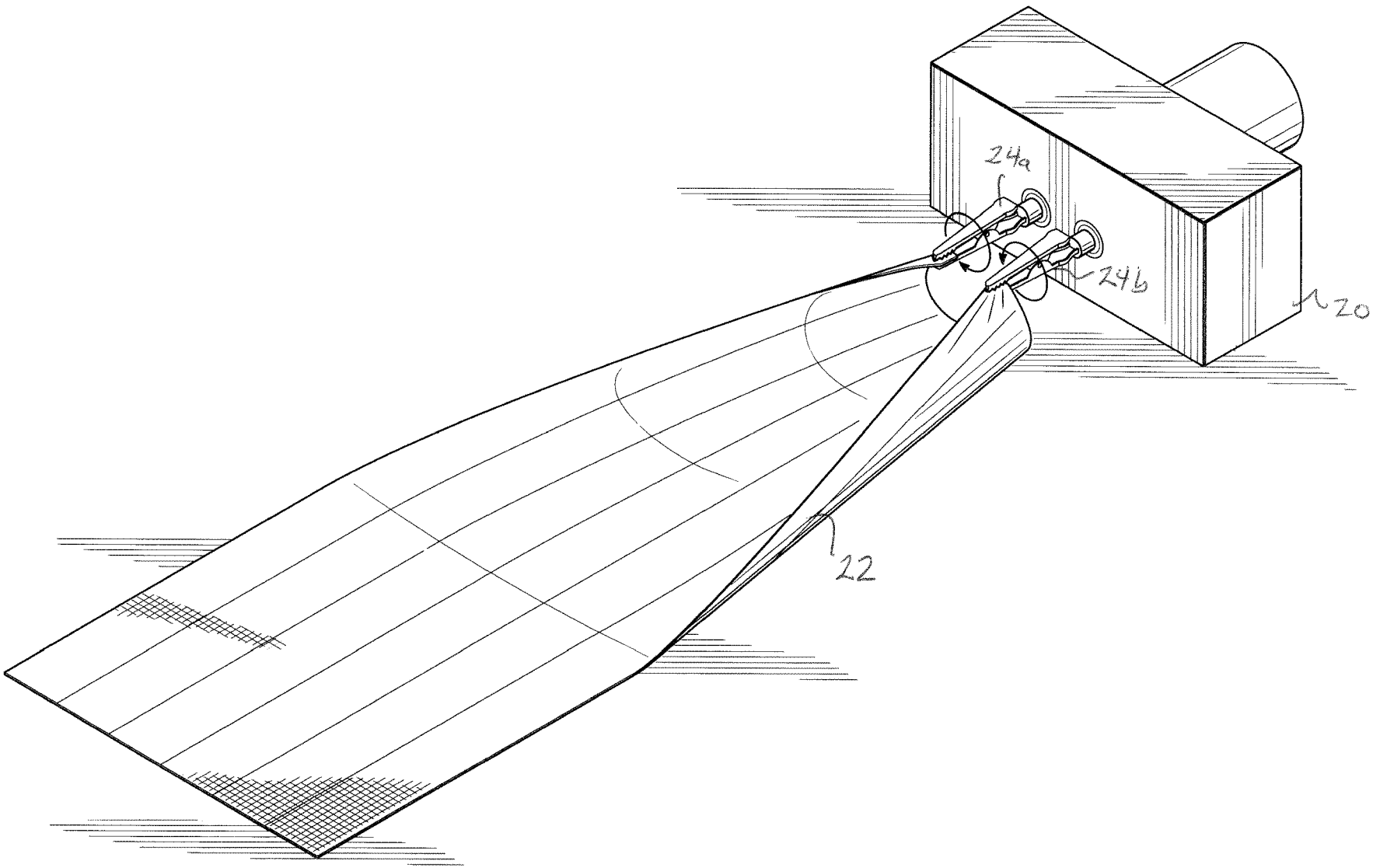
FIG. 5B shows the fabric engaged to the fixture and the commencement of rolling of the fabric.
Figure 5C:
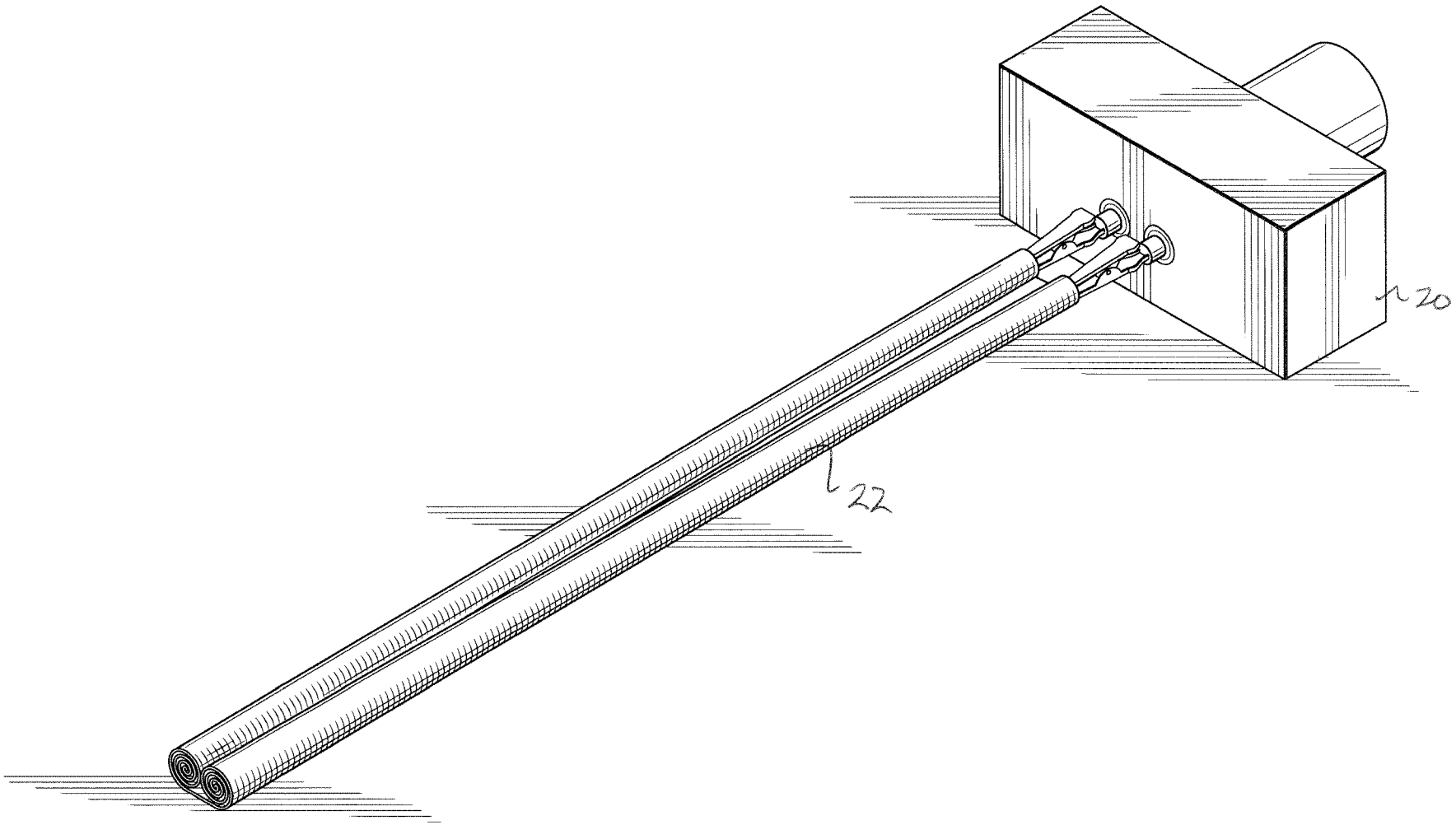
FIG. 5C shows the completely rolled main fabric section, ready for removal from the fixture.
Figure 5D:
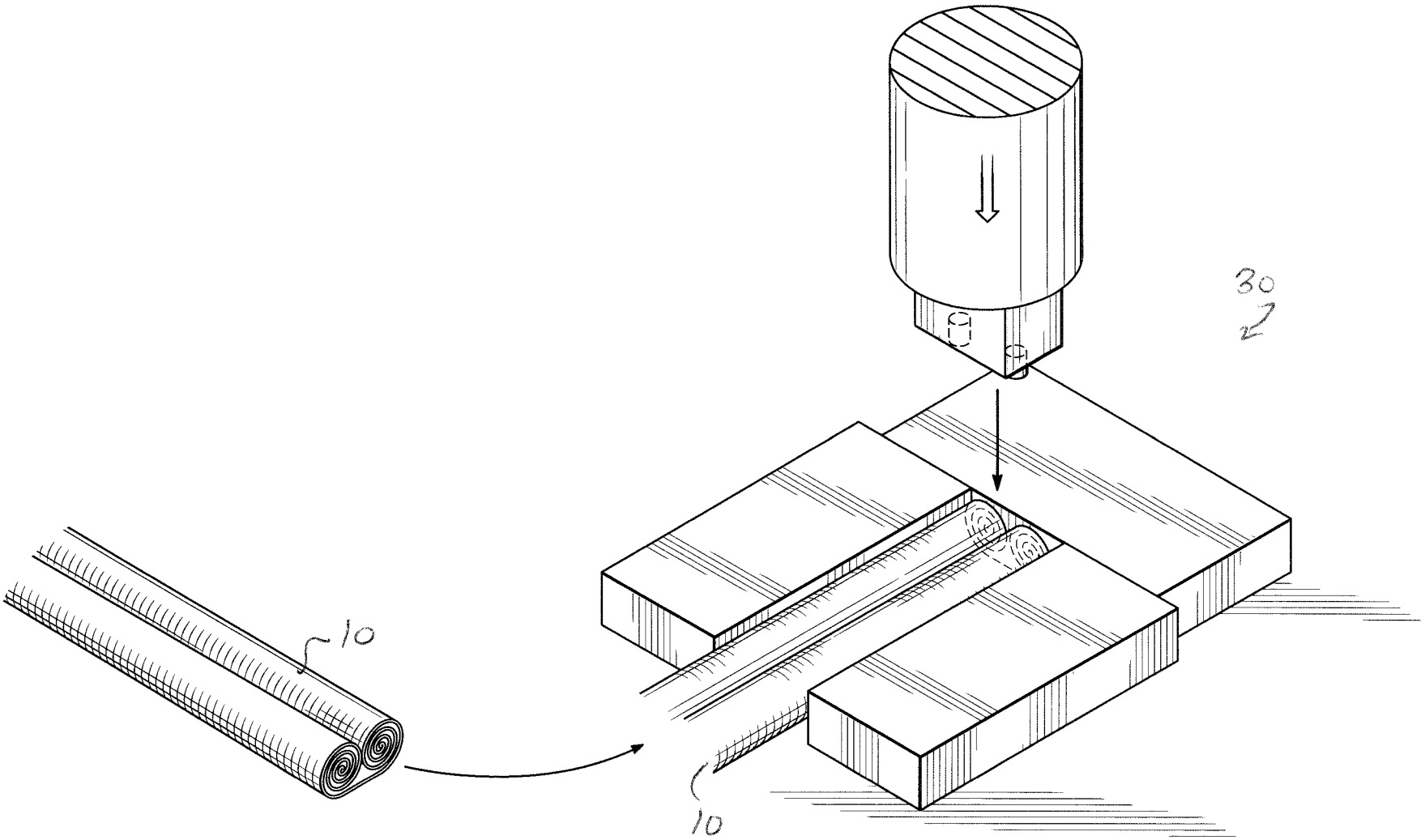
FIG. 5D is a perspective illustration of fixture used for ultrasonic welding of the rolled main section of a headband, showing the insertion of the rolled main section into the fixture.
Figure 5F:
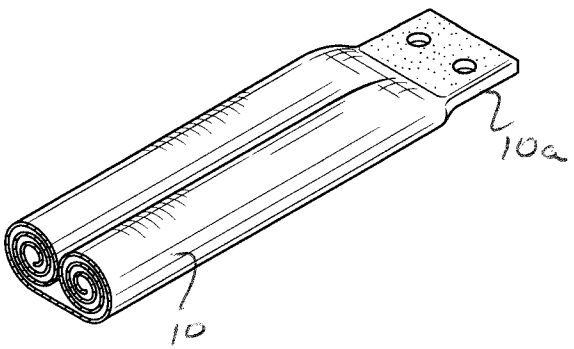
FIG. 5F illustrates the finished product after welding.
Figure 5E:
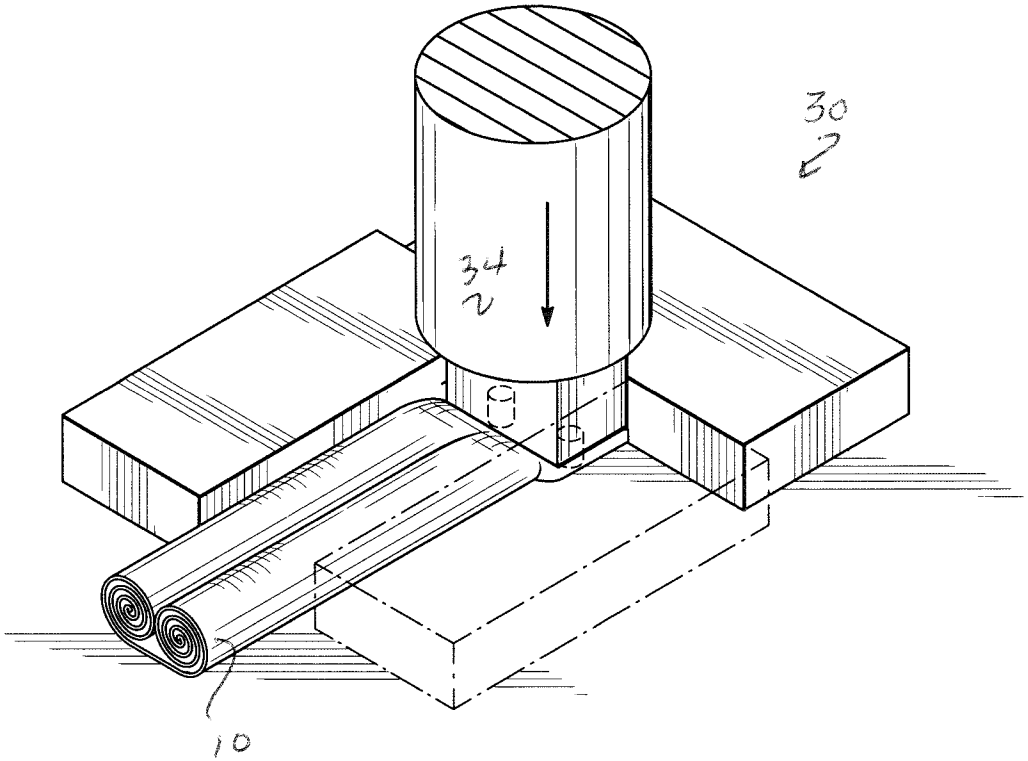
FIG. 5E is a perspective illustration of the compression of the rolled main section by the head of an ultrasonic welding tool.
Figure 6A:
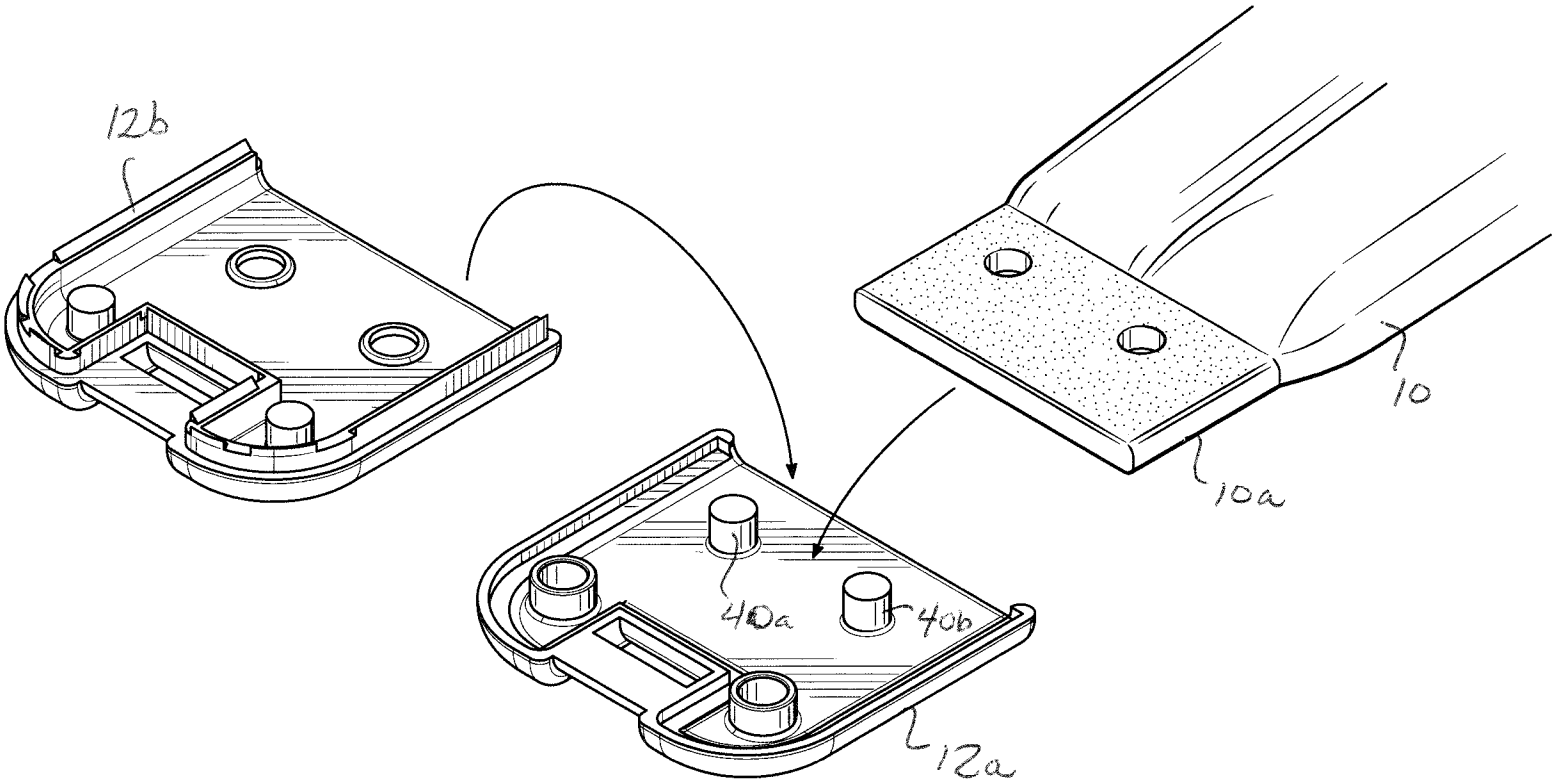
FIG. 6A illustrates the welded end of the rolled main section of a headband, being placed onto the pegs of one of two half sections of an end piece.
Figure 6B:
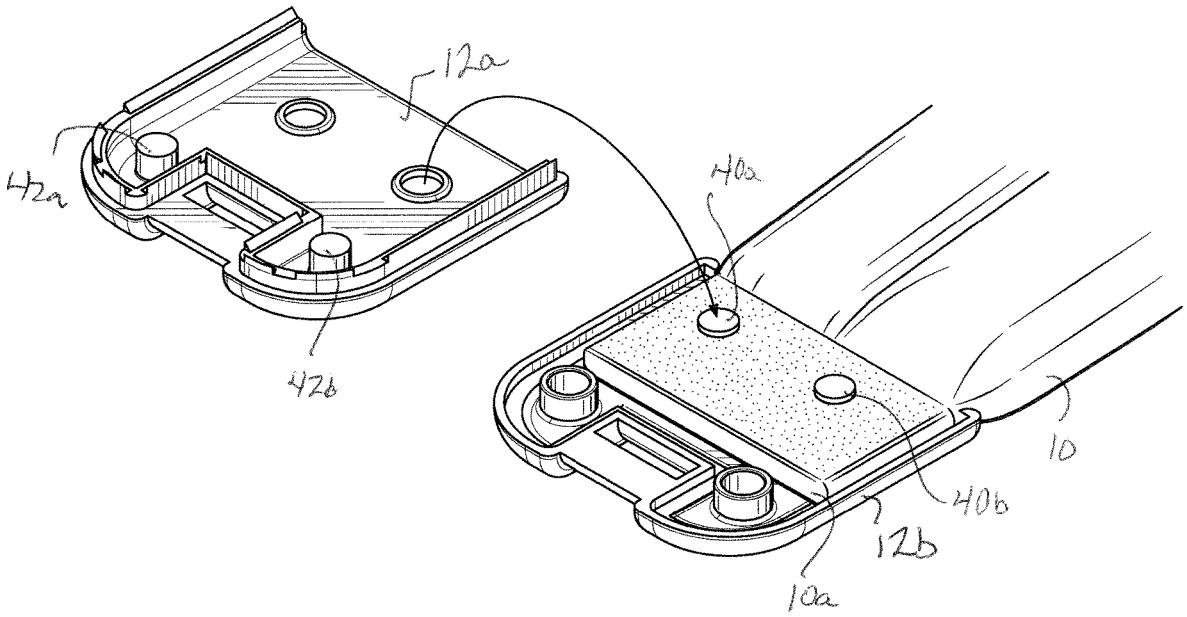
FIG. 6B illustrates the closure of the end piece half sections over the welded end of the main section.
Figure 6C:
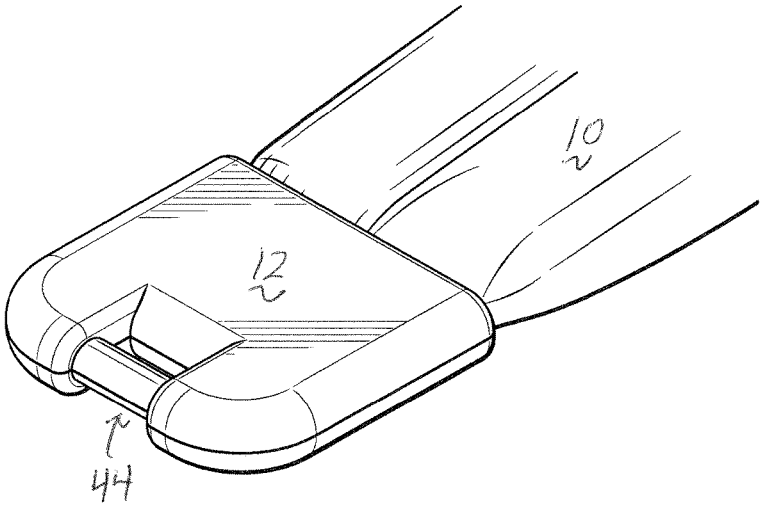
FIG. 6C illustrates the completed end piece, ready for ultrasonic welding about the end of the rolled main section.

FIG. 1 illustrates a headband in accordance with principles of the present invention, which includes a rolled fabric main section 10, terminating in end pieces 12 which are fastened together by an elastic strap 14 which incorporates a length adjusting buckle;

FIG. 2 illustrates the headband of FIG. 1 situated on the head of a wearer, showing the placement of the fabric main section 10 and end piece 12;

FIG. 3 illustrates the capability of adjusting the width of the headband of FIG. 1 by partially unrolling the main fabric section 10 to create a wider headband;

FIG. 4A is a cross section of the rolled main fabric section 10 of the headband in the generally tightly rolled configuration shown in FIG. 2, and FIG. 4B is a cross section of the rolled main fabric section 10 of the headband in the partially unrolled configuration shown in FIG. 3;

FIG. 5A is a perspective illustration of a fixture 20 used for rolling fabric into a rolled main section of a headband, showing fabric 22 which has been prepared for rolling but not yet processed by the fixture, FIG. 5B shows the fabric engaged to the jaws 24*a* and 24*b* of the fixture 20 and the commencement of rolling of the fabric 22, and FIG. 5C shows the completely rolled main fabric section 22, ready for removal from the fixture 20;

FIG. 5D is a perspective illustration of fixture 30 used for ultrasonic welding of the rolled main section 10 of a headband, showing the insertion of the rolled main section into the receiving groove 32 of the fixture 30, FIG. 5E is a perspective illustration of the compression of the rolled main section by the head 34 of an ultrasonic welding tool incorporated into the fixture 30, and FIG. 5F illustrates the welded end 10*a* of the rolled main section 10 of a headband after welding by the fixture 30; and FIG. 6A illustrates the welded end 10*a* of the rolled main section 10 of a headband, being placed onto the pegs 40*a* and 40*b* of one of two half sections 12*a* and 12*b* of an end piece 12. FIG. 6B illustrates the closure of the end piece half sections 12*a* and 12*b* over the welded end of the main section to engage the end piece half sections at the pegs 40*a* and 40*b* as well as pegs 42*a* and 42*b*, and FIG. 6C illustrates the completed end piece 12, ready for ultrasonic welding onto the end 12 of the rolled main section 10.

Elastic band 14 is subsequently ultrasonically welded to the aperture 44 in the completed end piece 12 to create the completed head band.

A headband of the type presented herein is comfortable and fashionable, and can be easily unrolled or rolled to create a desired headband width.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A headband that is suitable for use in sports or fashion ensembles with a sporting appearance, comprising:

a. an elongated fabric section formed from two oppositely-directed rolls of fabric rolled along an elongated length of the fabric section;

b. a first and a second end piece clamping said oppositely-directed rolls of fabric at an end of the elongated fabric section;

c. a strap connecting the first and second end pieces.

2. The headband of claim 1 wherein the headband fabric is a resilient, absorbent fabric.

3. The headband of claim 2 wherein the fabric is selected from a group including spandex or a blend of spandex with cotton and/or polyester.

4. The headband of claim 1 wherein the elongated fabric section may be rolled or unrolled to adjust a width of the fabric section of the headband perpendicular to its elongated length.

5. The headband of claim 1 wherein the strap comprises an adjustable buckle for adjusting the strap length.

6. The headband of claim 1 wherein the strap comprises a resilient fabric.

7. The headband of claim 6 wherein the resilient fabric is elastic.

8. A method of making a headband suitable for use in sports or fashion ensembles with a sporting appearance, comprising a. rolling an elongated fabric section from first and second edges thereof into oppositely directed rolls along an elongated length thereof;

b. welding the oppositely-directed rolls of fabric at each end of the elongated fabric section into first and second end pieces; and c. connecting the first and second end pieces with a strap.

9. The method of claim 8 further comprising ultrasonically welding the rolls of fabric at a first and a second end of the elongated fabric section, and then assembling the welded rolls of fabric into the first and second end pieces, respectively.

* * * * *